US005527005A

United States Patent [19]

Wydotis

[11] Patent Number: 5,527,005

[45] Date of Patent: Jun. 18, 1996

[54] SWING NOSE FROG SWITCH POINT ADJUSTER

[75] Inventor: Leonard M. Wydotis, Lexington, S.C.

[73] Assignee: Union Switch & Signal Inc., Pittsburgh, Pa.

[21] Appl. No.: 339,763

[22] Filed: Nov. 15, 1994

[51] Int. Cl.[6] ..... E01B 7/00

[52] U.S. Cl. ..... 246/452; 246/404

[58] Field of Search ..... 246/404, 407, 246/468, 415 R, 450, 452; 74/110; 254/102

[56] References Cited

U.S. PATENT DOCUMENTS

| | | | |
|---|---|---|---|
| Re. 3,584 | 8/1869 | Westinghouse, Jr. . | |
| 76,365 | 4/1868 | Westinghouse, Jr. | 246/464 |
| 1,159,319 | 11/1915 | Larry | 246/450 |
| 1,161,599 | 11/1915 | Bossert | 246/450 |
| 1,391,226 | 9/1921 | Weaver | 246/471 |
| 1,402,098 | 1/1922 | Shaw | 246/468 |
| 1,416,458 | 5/1922 | Gilmour | 246/458 |
| 1,425,253 | 8/1922 | Hardy | 246/380 |
| 1,428,220 | 9/1922 | Delk | 104/268 |
| 1,437,944 | 12/1922 | Maxwell | 246/383 |
| 1,450,758 | 4/1923 | Schwier | 246/388 |
| 1,457,632 | 6/1923 | Kershenstein | 246/464 |
| 1,461,701 | 7/1923 | Psilander | 246/460 |
| 1,495,954 | 5/1924 | Einstein | 246/456 |
| 1,501,822 | 7/1924 | Swift | 246/422 |
| 1,504,332 | 8/1924 | Einstein | 246/456 |
| 1,506,412 | 8/1924 | Crawford | 246/464 |
| 1,512,276 | 10/1924 | Conley | 246/276 |
| 1,523,003 | 1/1925 | Diehl | 246/454 |
| 1,537,508 | 5/1925 | Swift | 246/442 |
| 2,697,404 | 12/1954 | Brunner | 104/265 |
| 3,118,642 | 1/1964 | Vissat | 246/468 |
| 3,764,802 | 10/1973 | Webster | 246/468 |
| 4,362,282 | 12/1982 | Frank | 246/468 |
| 4,624,428 | 11/1986 | Frank | 246/276 |

FOREIGN PATENT DOCUMENTS

| | | | |
|---|---|---|---|
| 214826 | 5/1924 | United Kingdom | 246/452 |

*Primary Examiner*—Robert J. Oberleitner
*Assistant Examiner*—S. Joseph Morano
*Attorney, Agent, or Firm*—Buchanan Ingersoll; Robert J. Pugh

[57] ABSTRACT

An apparatus is provided for moving a movable switch point a selected distance as a result of the throw of a switch machine. The apparatus includes an operating rod connected to and movable by the switch machine and a switch point adjuster mounted directly to the switch point and movable by the operating rod. The switch point adjuster has an elongated housing with a bore provided therethrough, in which the operating rod is disposed through the housing bore. The switch point adjuster also has first and second adjusting nuts that are adjustably secured to the operating rod on opposed sides of the housing, preferably by mated threading. The operating rod is movable bidirectionally through the housing until one of the adjusting nuts contacts the housing. In this way, lost motion of the switch machine may be compensated for. The adjusting nuts preferably have a head portion and a body portion, in which the head portion has a width greater than the width of the body portion. Thus, the head portions of the adjusting nuts are contactable with respective opposed ends of the housing. Alternatively, or in addition, the housing may have an interior ledge provided within the housing bore, and leading edges of the adjusting nuts which are disposable within the housing may contact the interior ledge.

12 Claims, 3 Drawing Sheets

FIG. 5
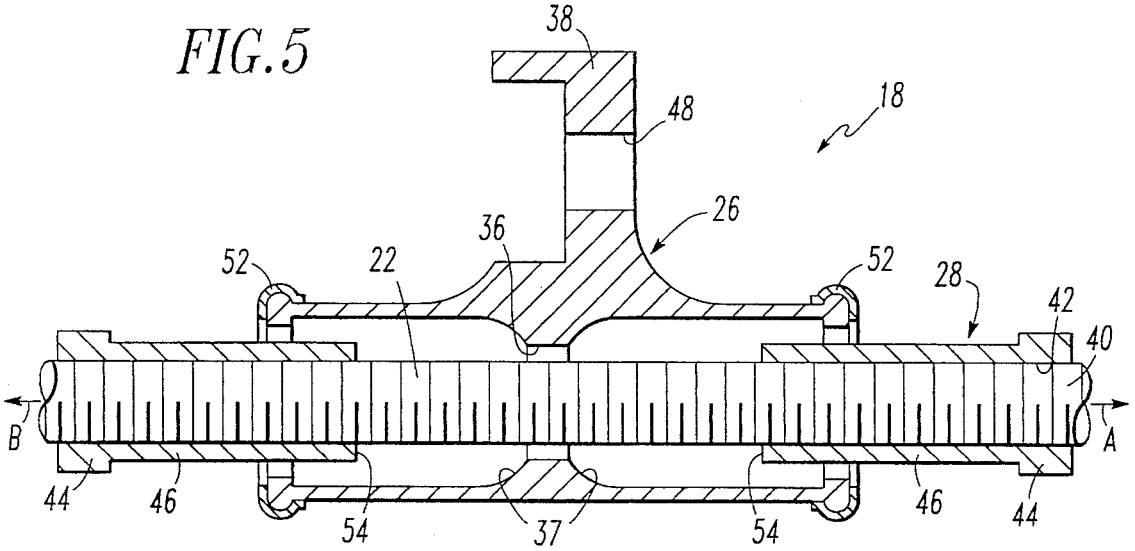
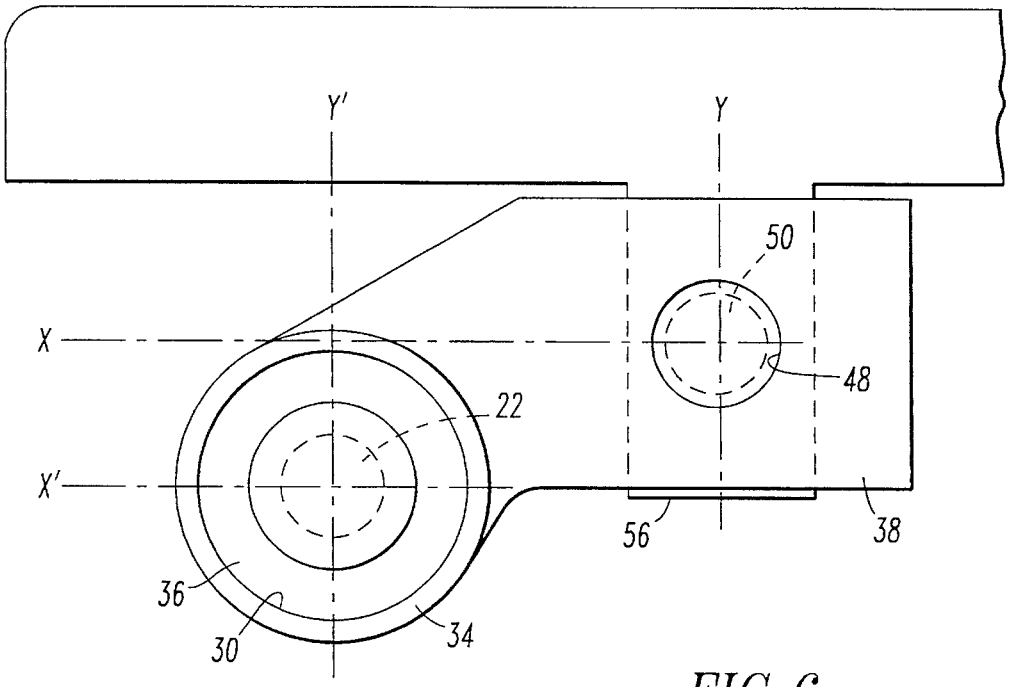
FIG. 6

SWING NOSE FROG SWITCH POINT ADJUSTER

BACKGROUND OF THE INVENTION

1. Field of the Invention

The invention relates to movable switch points for railway switches and, more particularly, to devices for compensating for lost motion between the throw of the switch machine and the movement of the switch point.

2. Description of the Prior Art

A "frog" is the location at which one rail crosses over or intersects another rail. In instances of high speed turnouts (i.e., where a railway vehicle switches from one track onto another track), the actual degree of switch or turnout may be very long because at higher speeds it is desirable that the train make the transition from one track to the other at a slower rate. Because of the long length of turnout, means have been devised in which to separate the rails.

One means to separate the rails is to make the frog section of the track a movable point. Thus, the frog which lies between and separates two sections of rail is connected to a means for moving the frog called a switch machine. An operating rod (also referred to as a "throw rod") is connected to and caused to be translated by the switch machine. The switch machine and operating rod, together with a second operating rod and a switch point adjuster (as described in more detail below), cause the switch point to move.

The distance by which the frog must be moved (i.e., the "throw") is typically between two inches and five inches. However, switch machines per AAR (Association of American Railroads) recommendations and standards, will always throw six inches, regardless of the type of switch machine utilized. Therefore, if the switch machine throw is six inches and is connected to the frog through a rigid connection, the frog also must be moved six inches. However, if the frog is only to be moved somewhere between two to five inches, a means must be used to compensate for the lost motion of the switch machine. For this reason, the switch machine is connected through an operating rod to a switch point adjuster.

A switch point adjuster is a device that compensates for switch machine operating lost motion and maintains switch point pressure on the frog or switch point as a train travels through. The switch point adjuster takes up the lost motion between the switch machine throw and the switch point displacement. This is done by allowing the switch operating rod to move a given distance before making contact with the opposite end of the switch point adjuster. Only after this given distance of travel does the machine begin to drive the switch points. Pressure between the extended sleeves of the operating rod and the switch point adjuster is present on one side of the adjuster—the side keeping the switch point closed. By adjusting the sleeves on the threaded operating rod, the point opening can therefore be adjusted to ensure that the point is closed and has adequate pressure on it when the train travels over the rail switch.

Referring to FIG. 1, a prior art switch point adjuster 2 is schematically depicted. As can be seen, the prior art switch point adjuster 2 utilizes two separate rods 3, 4. Two separate rods are used because maintenance personnel were unable to easily access the bottom of the switch point 16, therefore, there was no way of easily making any adjustments to the switch point adjuster 2 right at the point, as the track 14 itself would prevent access to the switch point adjuster 2. Thus, the switch point adjuster 2 was located at the center of the track 14 where maintenance personnel could access it. In order to do that, a two rod configuration was utilized: a first rod 3 connects the switch point adjuster 2 to the frog and a second rod 4 connects the switch point adjuster 2 to the switch machine 12. Thus, when the switch machine 12 throws six inches, the slack is taken up in the switch point adjuster 2 so that the frog is only moved its required amount. Both operating rods 3, 4 are supported by support rollers.

There are several drawbacks associated with this prior configuration. For example, if there is a problem with either of the operating rods, the amount of throw at the switch point may vary. Also, the flexure or lateral movement of both rods must be accounted for in designing the switch point adjuster. Furthermore, adjustments made to the switch point adjuster are more difficult when two operating rods have to be adjusted.

SUMMARY OF THE INVENTION

This invention provides an improved switch point adjuster for moving a movable switch point a selected distance as a result of the throw of a switch machine. A present preferred switch point adjuster mounts directly to the bottom of a swing nose frog switch point. This direct connection of the adjuster to the switch point eliminates the use of an additional throw rod such as is utilized in prior art swing nose frog switch point adjusters.

In addition to utilizing a switch point adjuster mounted directly to the switch point, the apparatus includes a single operating rod connected to and movable by the switch machine which engages with and moves the switch point adjuster. The switch point adjuster has an elongated housing with a bore provided therethrough, in which the operating rod is disposed through the housing bore. The switch point adjuster also has first and second adjusting nuts that are adjustably secured to the operating rod on opposed sides of the housing, preferably by mated threading.

The operating rod is movable bidirectionally through the housing until one of the adjusting nuts contacts the housing. In this way, lost motion of the switch machine may be compensated for at the switch point adjuster. The adjusting nuts preferably have a head portion and a body portion, in which the head portion has a width greater than the width of the body portion. Thus, the head portions of the adjusting nuts are contactable with respective opposed ends of the housing. Alternatively, or in addition, the housing may have an interior ledge provided within the housing bore, and leading edges of the adjusting nuts which are disposable within the housing may contact the interior ledge.

Use of a single throw rod that directly connects the switch machine to the switch point provides a more rigid connection and decreases the amount of lateral movement of the operating rod. Furthermore, indirect switch point adjustment (i.e., adjustment of the switch point position at a location remote from the switch point) is eliminated. The switch point adjuster is mounted directly to the bottom of the switch point, thus any adjustments of the adjusting nut that are made will directly effect the point opening. Because the length of the adjusting nuts may be varied, adjusting nuts can be selected that are long enough such that they extend out beyond the base of the rail. In this way, maintenance personnel can access and adjust the position of the adjusting nuts. This eliminates the need for two separate adjusting points in the assembly.

The connection of the switch machine directly to the switch point by a single operating rod eliminates the use of an additional rod in the assembly. The elimination of this rod then decreases the allowable lateral movement of the operating rod. The proposed switch point adjuster design simplifies assembly thereby reducing the required time for installation, maintenance and adjustment. Reducing the amount of material required in the assembly directly reduces the cost of the rail connection. Furthermore, the adjusting nuts are preferably coupled to the operating rod within a housing, thus the device is weather resistant. Also, because two adjusting nuts are provided, an offset in the adjustment may be made. Therefore, lost motion from the switch throw may be compensated for at the beginning of the throw toward the switch machine or the throw away from the switch machine.

The switch point adjuster is preferably constructed of a cast iron plug used in cooperation with steel adjusting nuts or sleeves mounted on the switch operating rod. However, any suitable material may be used to facilitate the components of the switch point adjuster. High strength steel hardware is preferably used to mount the adjuster to the track work. A lug is affixed to the frog and a mounting portion of the adjuster housing connects to the lug. The mounting portion is configured so that the cylindrical portion of the housing is provided below and spaced apart from the lug and the frog.

Other objects and advantages of the invention will become apparent from a description of certain presently preferred embodiments thereof shown in the drawings.

BRIEF DESCRIPTION OF THE DRAWINGS

FIG. 5 is a top view taken in cross section of a present preferred switch point adjuster.

FIG. 6 is a side elevational view of the present preferred switch point adjuster showing the offset of the housing mounting portion.

DETAILED DESCRIPTION OF THE PREFERRED EMBODIMENTS

Figure 1:
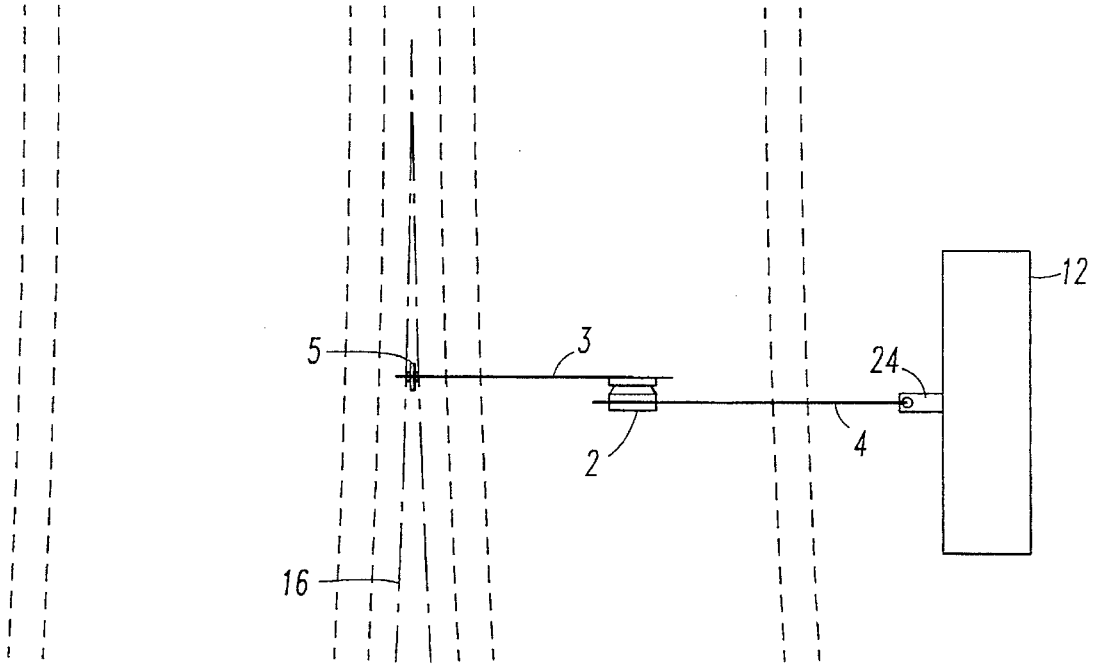
FIG. 1 PRIOR ART
FIG. 1 is a schematic depiction of a prior art switching configuration, showing a switch machine and a switch point adjuster utilizing two operating rods.
Figure 2:
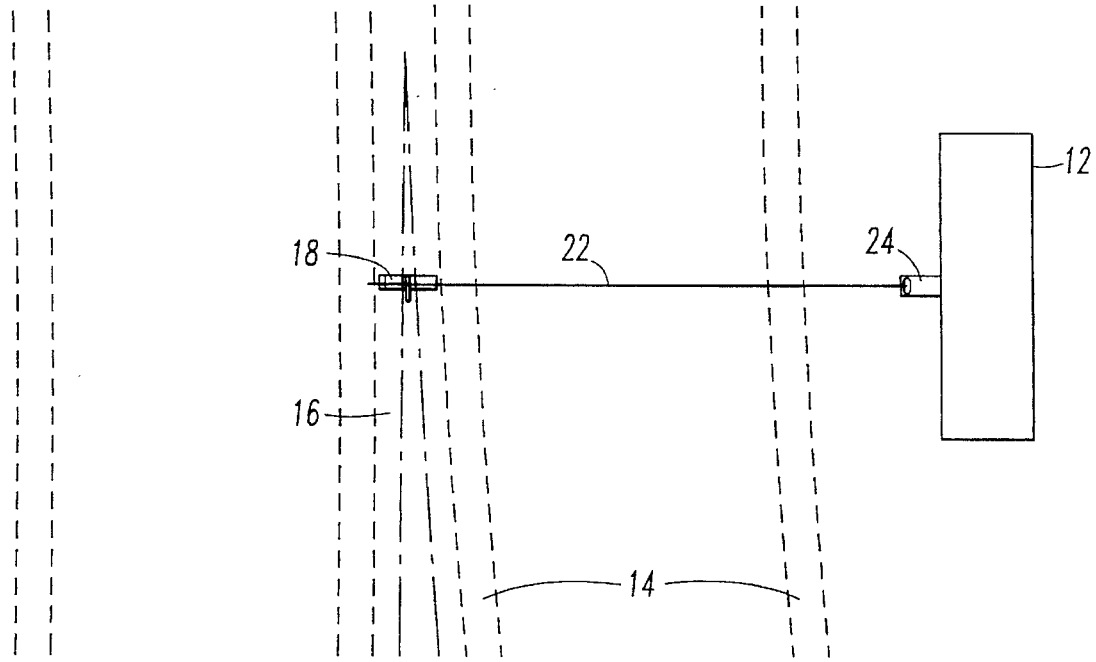
FIG. 2 is a schematic depiction of a present preferred switching configuration, showing a switch machine and the present switch point adjuster utilizing a single operating rod.

Referring next to FIG. 2, the present preferred switch point adjusting mechanism is shown. As can be seen, a switch machine 12 is situated wayside of two sets of rail track 14. A swing nose frog type switch point 16 is situated at the intersection of the two sets of rail track 14. The switch point adjuster 18 is mounted to the switch point 16. An operating rod 22 connects the switch point adjuster 18 to the switch machine 12. Other switch point equipment used at a switch site has been omitted.

When activated, the switch machine 12 has an operating bar 24 which moves, causing the operating rod 22 to translate bidirectionally either towards or away from the switch machine 12. When the switch machine 12 is placed into a first position of operation, the operating rod 22 is moved away from the switch machine 12, carrying the switch point adjuster 18 and thus the switch point 16 away from the switch machine 12 as well. When the switch machine 12 is placed in a second position of operation, the operating rod 22 is moved in a direction towards the switch machine 12 carrying the switch point adjuster 18 and thus the switch point 16 in a direction towards the switch machine 12.

As described above, the distance in which the operating rod 22 is caused to travel under either position of operation of the switch machine 12 is an industry standard distance of six inches per AAR recommendations and standards, regardless of the type of switch machine utilized. However, the switch point 16 must often be moved less than six inches, with the switch point movement required being dependent upon the design of the switch. Thus, the difference between the amount that the switch point 16 must be moved and the standard six inch travel (or "throw") of the switch machine 12 must be taken up by the switch point adjuster 18.

Figure 3:
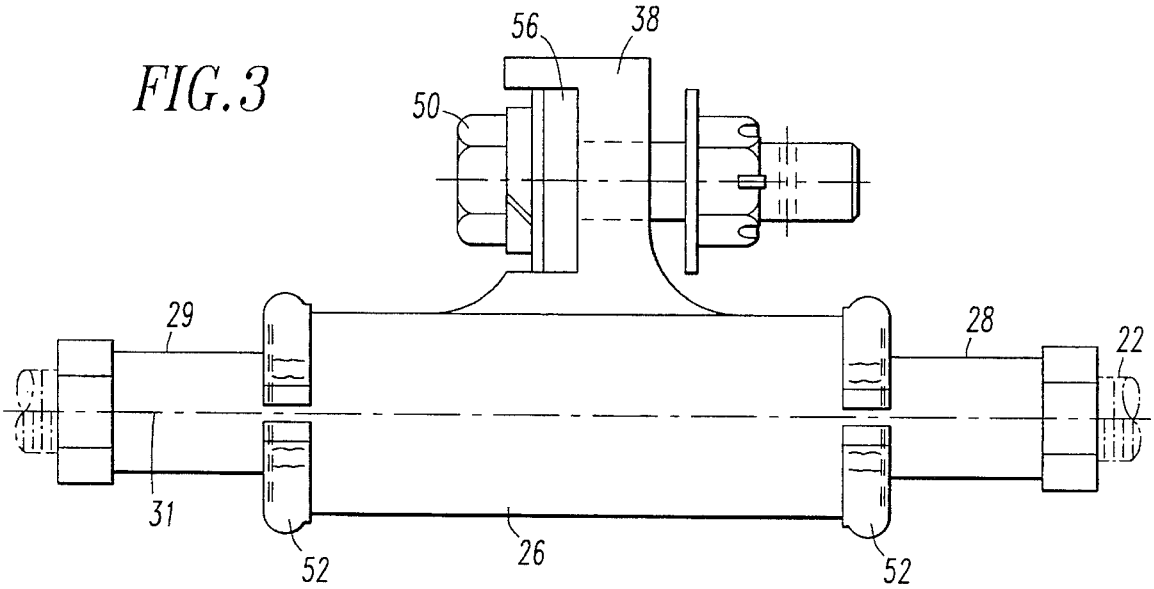
FIG. 3 is a top plan view of a present preferred switch point adjuster.
Figure 4:
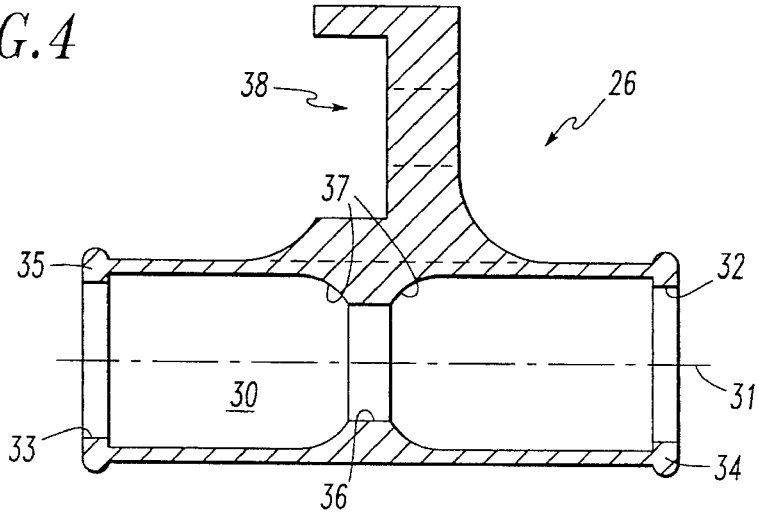
FIG. 4 is a top view taken in cross section of the housing of a present preferred switch point adjuster.

Referring next to FIGS. 3, 4 and 5, the present preferred switch point adjuster mechanism will be described in more detail. The principle components of the switch point adjuster 18 are a housing 26 having a single operating rod 22 disposed therethrough and a pair of adjusting nuts 28, 29 adjustably engaged to the operating rod 22 on opposed sides of housing 26.

Referring particularly to FIG. 4, the switch point adjuster housing 26 is shown. As can be seen in the figure, the housing 26 has an axial bore 30 extending along a longitudinal axis 31 of housing 26. The longitudinal axis 31 of the housing 26 is coincident with the axis of movement of the operating rod 22 (as will be described in more detail below). The housing bore 30 opens at openings 32, 33 which are provided at respective opposed ends 34, 35 of the housing 26. The housing bore 30 is preferably cylindrical, however, any suitable configuration of the bore 30 may be utilized.

It is further preferred that an internal ledge 36 be provided within the housing bore 30. Internal ledge 36 is also preferably annular, thus having opposed sides 37 and a cylindrical surface connecting the opposed sides. The internal ledge 37 also preferably has a transverse dimension (which is a diameter when the internal ledge 36 is annular) relative to the longitudinal axis 31 of the housing bore 30 which is less than the transverse dimension of the remaining portions of the housing bore 30. The housing 26 further has a mounting portion 38 for mounting the switch point adjuster 18 to the switch point 16.

Referring again to FIGS. 3, 4 and 5, a single operating rod 22 is disposed through the bore 30 of housing 26. Thus, the operating rod 22 extends outward from the housing 26 through the openings 32, 33 at respective opposed ends 34, 35 of the housing 26. Two adjusting nuts 28, 29 are secured to the operating rod 22, in which the position of the adjusting nuts 28, 29 along the operating rod 22 is adjustable. The preferred means by which the adjusting nuts 28, 29 are adjustably secured to the operating rod 22 is by being threadably mated to the operating rod 22. Thus, internal threading 42 which is provided within the adjusting nuts 28, 29 mates with threading 40 that is provided along the operating rod 22. The internal threading 42 may be provided along the entire inner surface of the adjusting nuts 28, 29 or only along some portion of the interior surface of the adjusting nuts 28, 29.

The adjusting nuts 28, 29 preferably have a head portion 44 and a body portion 46. It is preferred that the transverse dimension of the adjusting nut head portion 44 is greater than the transverse dimension of the adjusting nut body portion 46. It is further preferred that the adjusting nuts 28, 29 are generally sleeve-shaped. Thus, the adjusting nut body portion 46 is generally cylindrical and extends outward from the head portion 44. It is further preferred that the adjusting nut head portion 44 be five sided or six sided so as to be engagable with a wrench.

As can be seen best in FIGS. 3, 5 and 6, the housing mounting portion 38 preferably has a bolt opening 48 provided therethrough. In this way, a bolt 50 is preferably disposed through the bolt opening 48, engaging a portion of the switch point 16 (preferably a lug, 56, extending from the switch point), and thus securing the switch point adjuster 18 to the switch point 16.

Referring to FIG. 6, mounting portion 38 is preferably disposed at an angle from the remainder of housing 26. Preferably, the mounting portion 38 is disposed at a dog leg-type angle, i.e., the mounting portion 38 extends outward and upward from the remainder of housing 26. Thus, a bolt (shown in dotted line as 50 in FIG. 6) disposed through bolt opening 48 generally lies in a horizontal plane X that is a distance above a horizontal plane X' that the longitudinal axis of the housing and the operating rod 22 (shown in dotted line in FIG. 6) substantially lies. Bolt 50 then connects to a lug 56 that is affixed to the track of the switch point. Bolt 50 and plane X lie generally parallel with the track of the switch point. Therefore, the operating rod and the cylindrical portion of the housing may be disposed below the level of the track of the switch point. Similarly, bolt 50 lies in a vertical plane Y that is separated a distance from a vertical plane Y' in which the operating rod 22 lies. In this way, the present preferred switch point adjuster will not contact or otherwise have its movement inhibited by the track.

In operation, the adjusting nuts 28, 29 are secured to the operating rod 22 and the position of the adjusting nuts 28, 29 is adjusted until the adjusting nuts 28, 29 are at a desired location along the operating rod 22 relative to one another and relative to the housing 26. The operating rod 22 is then caused to move bidirectionally along the longitudinal axis 31 by the switch machine. Thus, the operating rod 22 moves either in the direction indicated by the arrow marked A in FIG. 5 or in the opposite direction indicated by the arrow marked B in FIG. 5.

Once the operating rod 22 has moved a sufficient distance in the direction indicated by the arrow marked A, the adjusting nut 29 will eventually contact the housing 26 carrying the housing 26, and thus the switch point 16, upon any further movement of the operating rod 22 in this direction. Similarly, when the operating rod 22 is then moved a sufficient distance in the direction indicated by the arrow marked B, the adjusting nut 28 will eventually contact the housing 26, causing any further movement of the operating rod 22 in this direction to move the housing 26, and thus the switch point 16, in this direction as well.

There will be some initial movement of the adjusting nuts 28, 29 before one of the adjusting nuts 28, 29 contact the housing 26. This distance of movement of the adjusting nuts 28, 29 prior to contact with the housing 26 is determined by the positioning of the adjusting nuts 28, 29 relative to one another and to the housing 26. Therefore, if the switch machine throws six inches (i.e., the operating rod 22 is caused to translate six inches) but the switch point is to move only four inches, then the adjusting nuts 28, 29 are positioned so as to move two inches before contacting the housing 26. If any adjustment is required in the amount of movement compensated for by the switch point adjuster 18, an operator need only adjust the position of either or both of the adjusting nuts 28, 29 along the operating rod 22 by rotating the adjusting nut 28, 29. As with any threadably engaged pieces, the rotation of the adjusting nuts 28, 29 causes the adjusting nuts 28, 29 to travel the threading of the operating rod 22 in either axial direction along the operating rod 22, depending upon the direction of rotation applied to the adjusting nuts 28, 29 (i.e., clockwise or counterclockwise).

In the preferred embodiments, the contact between the adjusting nuts 28, 29 and the access housing 26 occurs by a leading edge 54 of each adjusting nut 28, 29 contacting a side 37 of the internal ledge 36 of the housing 26. In this embodiment, the adjusting nut body portions 46 enter the housing bore 30 but are stopped by contact with the side 37 of the internal ledge 36. Thus, in this embodiment, the respective diameters of the adjusting nut body portions 46, the housing bore 30 and the internal ledge may be varied but the diameter of the adjusting nut body portions 46 must be less then the diameter of the housing bore 30 but greater than the diameter of the internal ledge 36.

Moreover, although the bore 30, the internal ledge 36 and the adjusting nut body portions 46 are each preferably cylindrical surfaces, any suitable configuration for these elements may be utilized so long as the adjusting nut body portions 46 may be disposed within and rotated along the operating rod 22 within the bore 30, but may not travel past the internal ledge 36. Furthermore, in the case in which the internal ledge 36 is configured as a cylindrical surface, it need not be a continuous cylinder. Thus, the internal ledge 36 may be semicylindrical or any segment of a cylinder or may be constructed of a number of separate segments.

In this way, the adjusting nuts 28, 29 are at least partially disposed within the housing 26. The internal threading 42 of the adjusting nuts 28, 29 is preferably provided along the end of the adjusting nut body portions 46 distal to the head portions 44. Thus, the internal threading 42 and the portion of the operating rod threading 40 upon which the adjusting nuts 28, 29 travel, are located within housing 26 and are thus protected from the elements and from foreign matter being caught in the threading 40, 42. The adjusting nut body portions, although having a diameter less than that of the housing bore 30, are preferably not much less in diameter, so that the space in the radial direction between the adjusting nut body portion and the portion of the housing 26 adjacent the axial bore 30 is sufficiently small so as to reduce the chance that foreign matter will enter the housing 26. The collars 52 provided along the opposed ends 34, 35 of the housing 26 may be designed to extend down very nearly into contact with the adjusting nut body portions so as to further prevent foreign matter from entering the housing bore 30.

It is understood that other means of contact between the adjusting nuts 28, 29 and the housing 26 are contemplated. For example, because it is preferred that the head portions 44 have a greater transverse dimension than the body portions 46, if the body portions 46 of adjusting nuts 28, 29 have a sufficiently small length, the head portions 44 of the adjusting nuts 28, 29 will contact the opposed ends 34, 35, respectively, of housing 26. It is preferred that collars 52 are secured to the housing 26 at opposed ends 34, 35 of the housing 26, thus, such contact between the head portions 44 of the adjusting nuts 28, 29 and the ends 34, 35 of the housing may occur either directly at the opposed ends 34, 35 or through contact with the collars 52. The collars 52 may be secured to the opposed ends 34, 35 by any convenient means.

It is also possible that the head portions 44 and the body portions 46 of the adjusting nuts 28, 29 be of a uniform dimension in the transverse direction. In this way, the adjusting nuts 28, 29 need only be long enough in the longitudinal direction to contact the internal ledge 36 and still be accessible exterior to the openings 32, 33 of the housing.

Alternatively, when the head portions 44 and the body portions 46 of the adjusting nuts 28, 29 are of uniform dimension in the transverse direction, the adjusting nuts 28, 29 need only have a sufficient dimension in the transverse dimension so as to be greater than the transverse dimensions of the openings 32, 33 so that the adjusting nuts 28, 29 contact the opposed ends 34, 35 around openings 32, 33 and are thus not able to enter the housing bore 30.

In any of the embodiments in which contact between the adjusting nuts and the housing is not made at the internal ledge 36, the internal ledge would not be required. Thus, the housing bore 30 may be of uniform dimensions in such embodiments.

In any of the embodiments, it is preferred that the length of the adjusting nuts 28, 29 in the longitudinal direction be sufficient so that the adjusting nut head portions 44 extend out beyond the base of the rail when the switch point adjuster 18 is mounted to the bottom of the switch point. Thus, the adjusting nuts 28, 29 are readily accessible by an operator despite being mounted directly to the switch point.

While certain presently preferred embodiments have been shown and described, it is distinctly understood that the invention is not limited thereto but may be otherwise embodied with the scope of the following claims.

I claim:

1. A switch assembly combination, comprising:

a swing nose frog, single, movable switch point;

a switch machine located a selected distance from the switch point and having a selected throw;

a single operating rod connected to and movable by the switch machine; and a switch point adjuster having an integral mounting portion that is affixable to the switch point, wherein said switch point adjuster is movable a selected distance by said operating rod in response to the throw of the switch machine, said switch point adjuster further having means for adjusting the selected distance of the movement of the switch point in response to the throw of the switch machine.

2. The combination of claim 1 wherein said switch point adjuster comprises:

an elongated housing having a bore disposed therethrough, wherein said operating rod is disposed through said housing bore; and first and second adjusting nuts, said adjusting nuts being adjustably secured to said operating rod on opposed sides of said housing, and wherein said operating rod is movable bidirectionally through said housing until one of said adjusting nuts contacts said housing, and wherein once said one of said adjusting nuts contacts said housing, further movement of said operating rod moves said housing.

3. The combination of claim 2 wherein each such adjusting nut has a head portion and a body portion, wherein said body portion has a width and said head portion has a width greater than the width of said body portion, and wherein said head portions of said adjusting nuts are contactable with respective opposed ends of said housing.

4. The combination of claim 3 wherein said adjusting nuts are threadably engaged to the operating rod, such that threading provided on an interior surface of the adjusting nuts mates with threading provided on the operating rod.

5. The combination of claim 4 wherein said threaded portion of said adjusting nuts are engaged to said operating rod within said housing.

6. The combination of claim 2 further comprising an interior ledge provided within said housing bore, and wherein each adjusting nut has a head portion and a body portion, wherein said adjusting nut body portions each having a leading edge portion disposable within said housing that are contactable with said interior ledge.

7. The combination of claim 6 wherein said interior ledge has at least two abutment surfaces on opposing sides of said ledge engagable with respective ones of said leading edge portion of said adjusting nuts.

8. The combination of claim 6 wherein said adjusting nuts are threadably engaged to the operating rod, such that threading provided on an interior surface of the adjusting nuts mates with threading provided on the operating rod.

9. The combination of claim 8 wherein said threaded portion of said adjusting nuts are engaged to said operating rod within said housing.

10. The combination of claim 1 further comprising a mounting portion extending from said housing, wherein said mounting portion has means for attachment to said switch point.

11. The combination of claim 10 wherein said mounting portion is sized and configured such that said means for attachment to said switch point and said switch point lie substantially in a horizontal plane lying above a longitudinal axis of said housing.

12. The combination of claim 11 wherein said housing portion is sized and configured such that said means for attachment to said switch point lies substantially in a vertical plane separated from said longitudinal axis of said housing.

* * * * *